US010745974B2

(12) United States Patent
Slettene et al.

(10) Patent No.: US 10,745,974 B2
(45) Date of Patent: Aug. 18, 2020

(54) HOISTING SYSTEM

(71) Applicant: MHWIRTH AS, Kristiansand (NO)

(72) Inventors: Atle Slettene, Vennesla (NO); Tord Aslak Aslaksen, Lillesand (NO)

(73) Assignee: MHWIRTH AS, Kristiansand (NO)

( * ) Notice: Subject to any disclaimer, the term of this patent is extended or adjusted under 35 U.S.C. 154(b) by 130 days.

(21) Appl. No.: 16/098,873

(22) PCT Filed: May 4, 2017

(86) PCT No.: PCT/NO2017/050108

§ 371 (c)(1),
(2) Date: Nov. 5, 2018

(87) PCT Pub. No.: WO2017/192046

PCT Pub. Date: Nov. 9, 2017

(65) Prior Publication Data

US 2019/0145185 A1 May 16, 2019

(30) Foreign Application Priority Data

May 6, 2016 (NO) ..... 20160761

(51) Int. Cl.
*E21B 15/02* (2006.01)
*E21B 19/00* (2006.01)
(Continued)

(52) U.S. Cl.
CPC ..... *E21B 15/02* (2013.01); *E21B 19/002* (2013.01); *E21B 19/006* (2013.01); *E21B 19/008* (2013.01); *E21B 19/02* (2013.01); *E21B 19/084* (2013.01); *E21B 19/086* (2013.01); *E21B 19/09* (2013.01)

(58) Field of Classification Search
CPC .... E21B 19/002; E21B 19/006; E21B 19/008; E21B 19/02; E21B 19/084; E21B 19/086; E21B 19/09; B66C 13/02; B66C 13/08
See application file for complete search history.

(56) References Cited

U.S. PATENT DOCUMENTS 3,606,854 A * 9/1971 Van Lunteren ..... B63C 11/44 114/294
3,743,249 A * 7/1973 van Daalen ..... B63B 35/4413 254/273

(Continued)

FOREIGN PATENT DOCUMENTS

GB 2561111 A 10/2018
SE 416 944 B 2/1981

(Continued)

*Primary Examiner* — Michael E Gallion
(74) *Attorney, Agent, or Firm* — Norman B. Thot

(57) ABSTRACT

A hoisting system includes a hoisting cylinder assembly which is arranged vertically. The hoisting cylinder assembly includes at least one hoisting cylinder, a lower part, and an upper part, the upper part being moveable in relation to the lower part. At least one sheave is arranged in the upper part of the hoisting cylinder assembly. A winch which includes a base is fixed in relation to the lower part. A first wire is operatively connected to the winch and extends from the winch via the at least one sheave to a yoke so as to suspend the yoke from the at least one sheave.

12 Claims, 10 Drawing Sheets

(51) Int. Cl.

| | |
|---|---|
| ***E21B 19/02*** | (2006.01) |
| ***E21B 19/084*** | (2006.01) |
| ***E21B 19/086*** | (2006.01) |
| ***E21B 19/09*** | (2006.01) |

(56) References Cited

U.S. PATENT DOCUMENTS

| | | | | |
|---|---|---|---|---|
| 4,341,373 | A | 7/1982 | Mouton, Jr. | |
| 4,552,339 | A * | 11/1985 | Werners | B66C 13/02 254/277 |
| 5,421,468 | A * | 6/1995 | Wright | B66C 11/16 212/250 |
| 5,520,369 | A * | 5/1996 | Chatard | B66C 13/02 254/277 |
| 6,032,929 | A | 3/2000 | Vatne | |
| 6,095,501 | A | 8/2000 | Vatne | |
| 6,857,483 | B1 | 2/2005 | Dirks et al. | |
| 7,543,799 | B2 * | 6/2009 | Willis | B63B 21/18 254/336 |
| 7,905,300 | B2 * | 3/2011 | Rieder | E21B 15/00 175/122 |
| 8,235,228 | B2 * | 8/2012 | Vasstrand | B63B 27/10 212/256 |
| 8,616,529 | B2 * | 12/2013 | Kim | B66D 1/50 254/335 |
| 10,633,936 | B2 * | 4/2020 | Aslaksen | E21B 19/008 |
| 2003/0123957 | A1 * | 7/2003 | Jordan | E21B 19/006 414/138.2 |
| 2005/0191165 | A1 * | 9/2005 | Willis | B63B 21/22 414/803 |
| 2008/0105433 | A1 * | 5/2008 | Christopher | B66D 1/52 166/355 |
| 2009/0139731 | A1 * | 6/2009 | Rieder | E21B 19/084 166/381 |
| 2009/0314547 | A1 * | 12/2009 | Stoetzer | E21B 7/023 175/57 |
| 2014/0246203 | A1 | 9/2014 | Pøhner | |
| 2016/0024852 | A1 | 1/2016 | Kannegaard et al. | |
| 2016/0137466 | A1 | 5/2016 | Eriksson et al. | |
| 2017/0327192 | A1 * | 11/2017 | Huot | B65G 65/06 |
| 2017/0341717 | A1 * | 11/2017 | Roodenburg | E21B 7/12 |
| 2019/0092610 | A1 * | 3/2019 | Trail | B66C 13/02 |
| 2019/0112881 | A1 | 4/2019 | Aslaksen et al. | |

FOREIGN PATENT DOCUMENTS

| | | | |
|---|---|---|---|
| WO | WO 97/23705 | A1 | 7/1997 |
| WO | WO 97/24507 | A1 | 7/1997 |
| WO | WO 01/77000 | A1 | 10/2001 |
| WO | WO 2013/076207 | A2 | 5/2013 |
| WO | WO 2014/140367 | A2 | 9/2014 |
| WO | WO 2014/209131 | A1 | 12/2014 |
| WO | WO 2015/189368 | A2 | 12/2015 |

* cited by examiner

HOISTING SYSTEM

CROSS REFERENCE TO PRIOR APPLICATIONS

This application is a U.S. National Phase application under 35 U.S.C. § 371 of International Application No. PCT/NO2017/050108, filed on May 4, 2017 and which claims benefit to Norwegian Patent Application No. 20160761, filed on May 6, 2016. The International Application was published in English on Nov. 9, 2017 as WO 2017/192046 A1 under PCT Article 21(2).

FIELD

The present invention relates to a hoisting system, and more particularly to a hoisting system for floating vessels including but not limited to such hoisting systems used for offshore oil and gas exploration and exploitation.

BACKGROUND

Known technology for hoisting or lifting systems on vessels, e.g., drilling-, intervention- and service vessels used in the offshore market, include winch-based systems (e.g., so-called drawworks) with a multiple stringed block. These may be arranged in a single wire or multi-wire setup. An alternative solution is a cylinder lifting rig, such as the RamRig™ technology.

A conventional configuration with drawworks uses a drum which winds up a single hoisting wire with very high line speed due to the gearing factor in the travelling- and crown block system. An example of a possible arrangement is described in WO 2013/076207 A2. A further example of a winch-based hoisting system is described in WO 2014/209131 A1 where the winch-based hoisting system comprises a winch with a winch drum, an elongated hoisting member, and where the elongated hoisting member is accommodated in a single layer on the winch drum.

A cylinder lifting configuration may utilise cylinders pushing directly onto a yoke on which a number of sheaves are attached. The hoisting wire is attached to an anchor at one end and to a load at the other end. The lifting speed is 2:1 between the load and the cylinder movement. A set of parallel wires can be arranged to lift a common load. An example of a possible arrangement is described in WO 97/23705.

Other documents useful for understanding the field of technology of the present invention include WO 2014/140367, US 2005/0191165, U.S. Pat. Nos. 4,552,339, 4,341,373, WO 97/24507, WO 01/77000, and U.S. Pat. No. 3,606,854.

Such hoisting systems for vessels will commonly be required to operate under varying operational conditions according to the particular operation carried out, for example, drilling, well intervention, or subsea installation. This may range from having to carry out very heavy lifts, to carrying out lighter lifts but where a high lifting speed is required. This is a challenge for designers of such systems since trade-offs will often exist between the different operational functionality and performance that can be realised.

SUMMARY

An aspect of the present invention is to provide an improved hoisting system to reduce or eliminate the above-mentioned disadvantages of known techniques. Another aspect of the present invention is to provide further advantages over the state of the art.

In an embodiment, the present invention provides a hoisting system which includes a hoisting cylinder assembly which is arranged vertically. The hoisting cylinder assembly comprises at least one hoisting cylinder, a lower part, and an upper part, the upper part being moveable in relation to the lower part. At least one sheave is arranged in the upper part of the hoisting cylinder assembly. A winch comprising a base is fixed in relation to the lower part. A first wire is operatively connected to the winch and extends from the winch via the at least one sheave to a yoke so as to suspend the yoke from the at least one sheave.

BRIEF DESCRIPTION OF THE DRAWINGS

The present invention is described in greater detail below on the basis of embodiments and of the drawings in which.

DETAILED DESCRIPTION

In an embodiment, the present invention provides a hoisting system comprising:

- a vertically arranged hoisting cylinder assembly having at least one hoisting cylinder, the hoisting cylinder assembly having a lower part and an upper part, the upper part being moveable in relation to the lower part;
- at least one sheave arranged in the upper part of the hoisting cylinder assembly;
- a winch having a base which is fixed in relation to the lower part; and
- a wire operatively connected to the winch and extending from the winch via the at least one sheave to a yoke so as to suspend the yoke from the at least one sheave.

In an embodiment, the present invention provides a hoisting system comprising:

- a vertically arranged hoisting cylinder assembly having at least one hoisting cylinder, the hoisting cylinder assembly having a lower part and an upper part, the upper part being moveable in relation to the lower part;
- at least one sheave arranged in the upper part of the hoisting cylinder assembly;
- a winch having a base which is fixed in relation to the lower part;
- a wire anchor, the wire anchor being fixed in relation to the lower part; and
- a wire extending via the at least one sheave to a yoke so as to suspend the yoke from the at least one sheave,
- wherein, the wire is configured to connect to the winch and/or to the anchor.

In an embodiment, the present invention provides a hoisting system comprising:

a vertically arranged hoisting cylinder assembly having at least one hoisting cylinder, the hoisting cylinder assembly having a lower part and an upper part, the upper part being moveable in relation to the lower part;

at least one sheave arranged in the upper part of the hoisting cylinder assembly;

a winch having a base which is fixed in relation to the lower part; and a wire configured to extend from the winch via the at least one sheave and through an opening in a drill floor.

The hoisting system may further comprise a wire anchor, the wire anchor being fixed in relation to the lower part, and a second wire configured to extend from the wire anchor via the at least one sheave to a yoke so as to suspend the yoke from the at least one sheave.

The present invention also provides methods for operating a hoisting system and a floating structure having a hoisting system. The floating structure may be a drilling rig or a drillship.

Advantageous embodiments of the present invention will now be described in relation to a drilling rig, however, it is to be understood that the present invention may be suitable for various other applications, including but not limited to well intervention, subsea equipment installation, and other offshore lifting operations.

Figure 1:
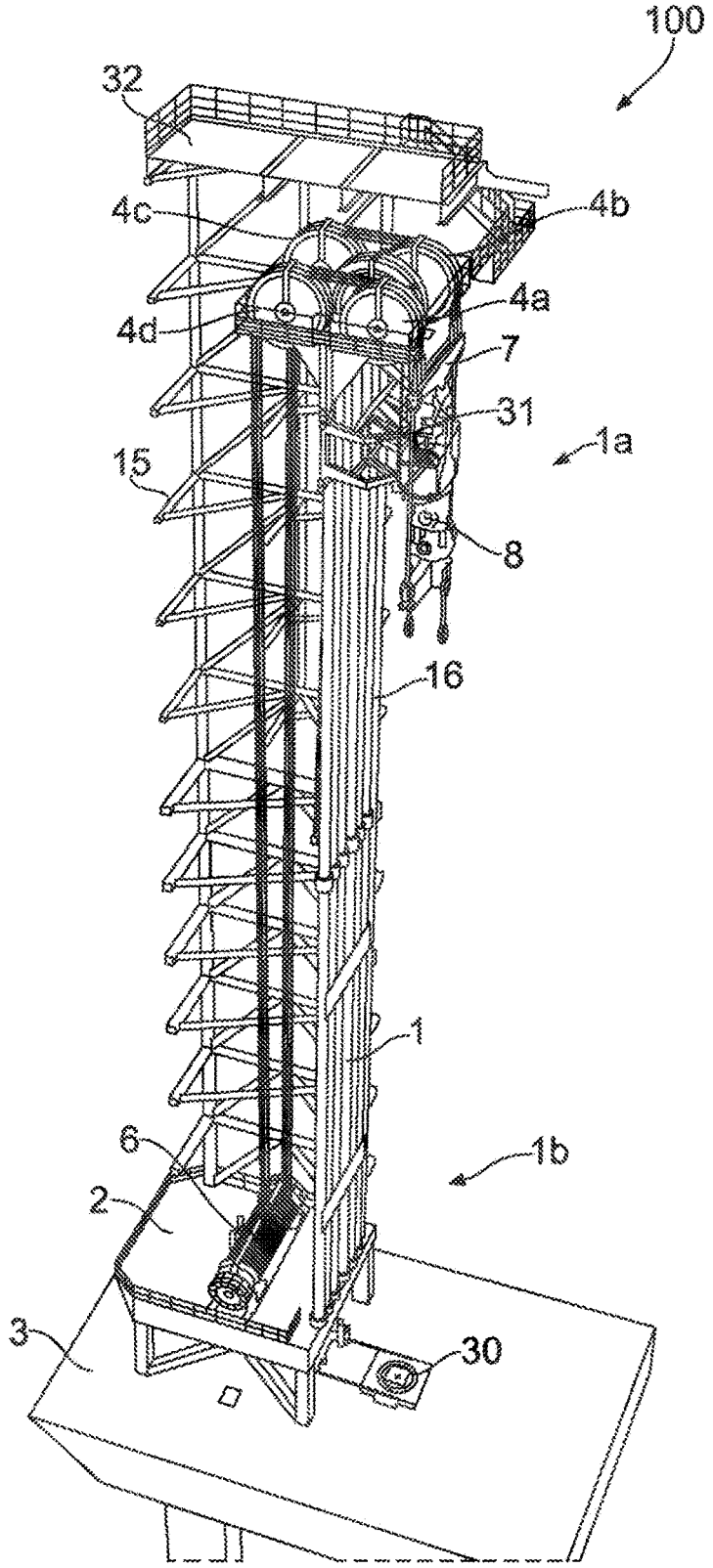
FIG. 1 shows a hoisting system.
Figure 2:
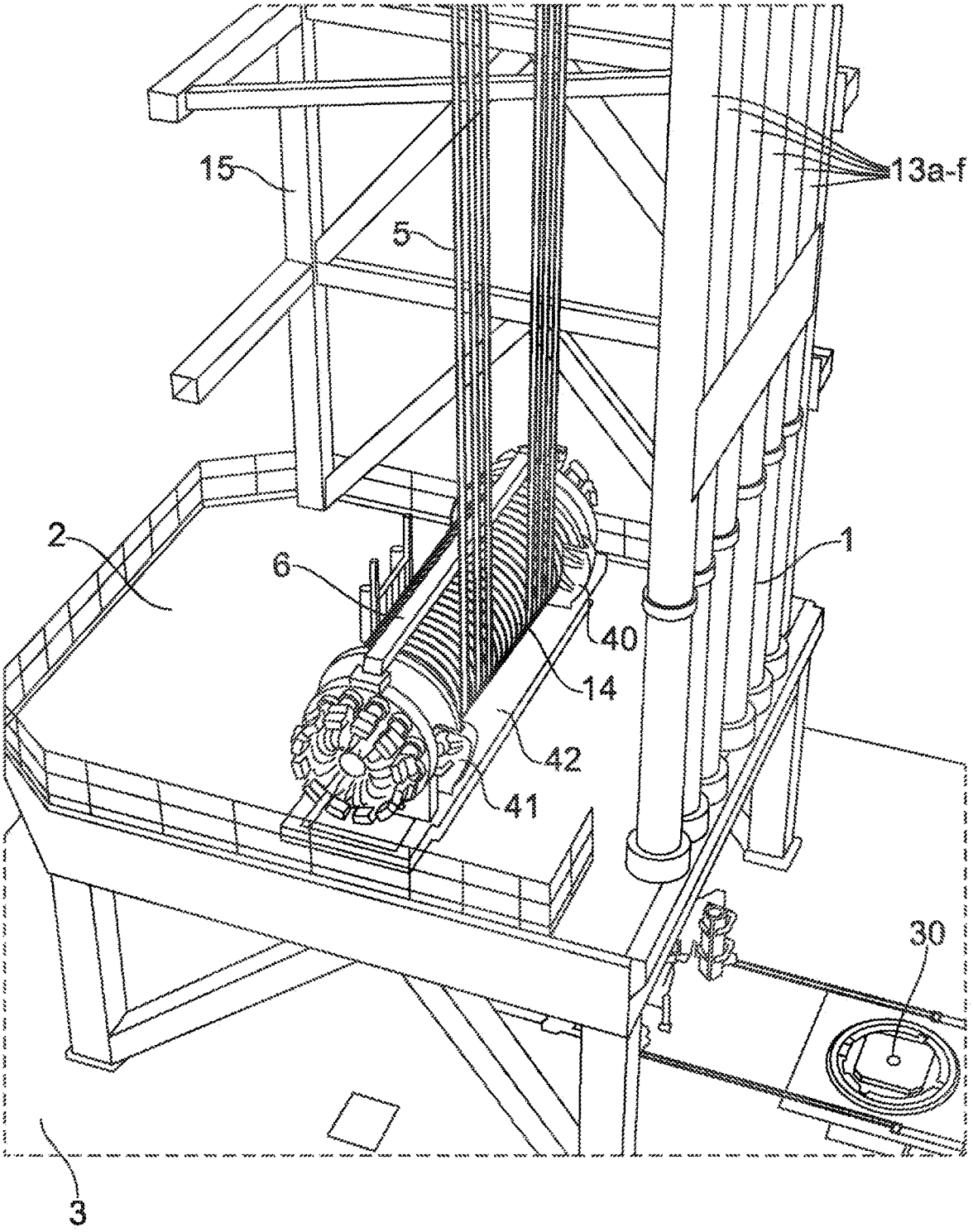
FIG. 2 shows details of the hoisting system of FIG. 1.
Figure 3:
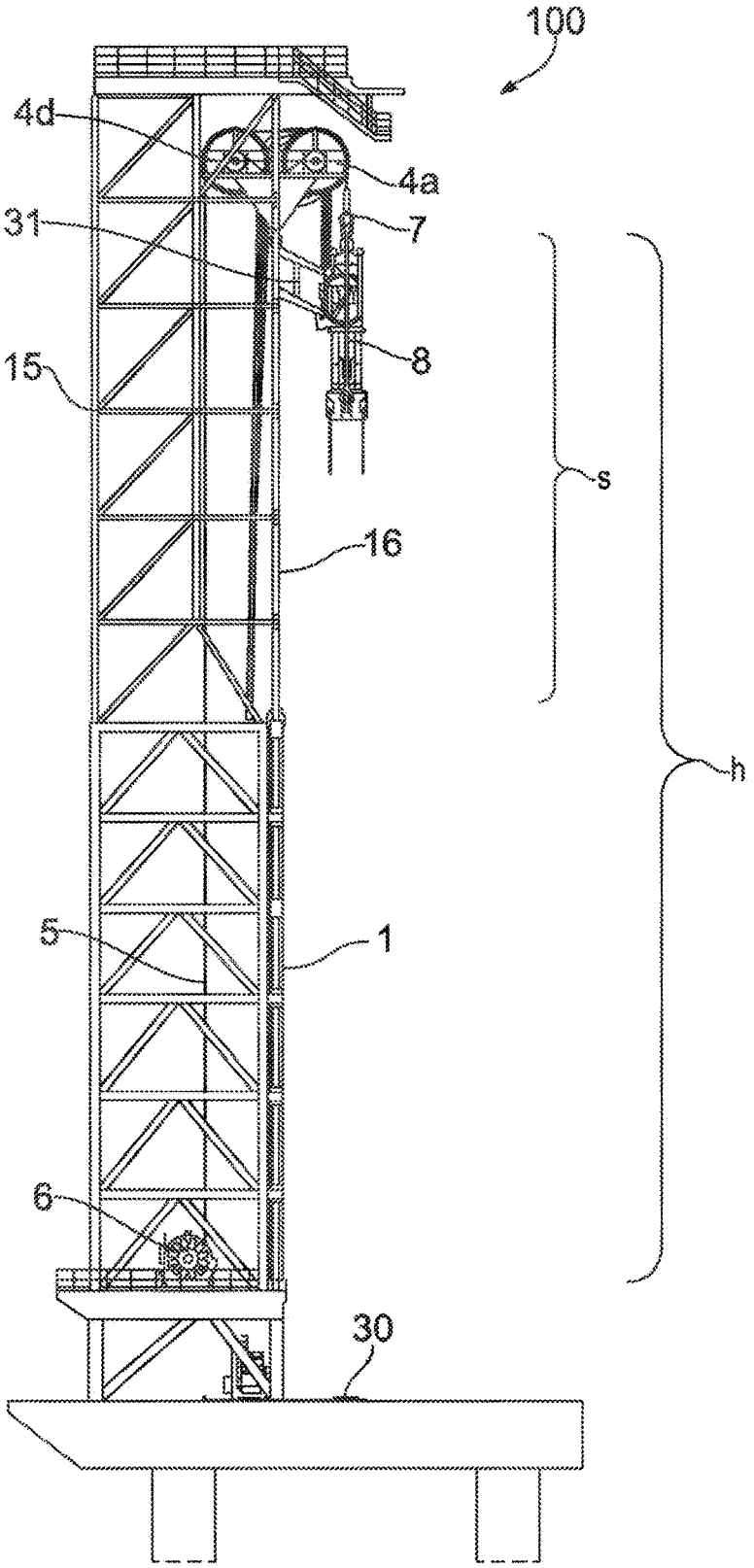
FIG. 3 shows a side view of the hoisting system of FIG. 1.

FIGS. 1-3 show an embodiment of a hoisting system 100 for a vessel according to the present invention. The hoisting system 100 has a vertically arranged hoisting cylinder assembly 1, which has a lower part 1*b* and an upper part 1*a*. The hoisting cylinder assembly 1 may comprise one or more individual hoisting cylinders; six individual hoisting cylinders 13*a-f* are used in the shown embodiment. The hoisting cylinder assembly 1 is mounted on and supported by a deck structure, here shown as a drill floor 3 and an upper drill floor 2. Having an elevated upper drill floor 2, as shown in this embodiment, is optional and all equipment may, alternatively, be arranged on drill floor 3. The drill floor 3 has an opening 30 defining a well center. In use, a tubular may extend through the opening 30 and extend downwards towards the sea floor and/or into a subsea well. The tubular may be a drill string used for drilling, for well intervention operations, or for installing or removing equipment subsea.

A plurality of sheaves 4*a*-4*d* are arranged in the upper part 1*a* of the hoisting cylinder assembly 1. A wire 5 extends upwards from the upper drill floor 2, via the sheaves 4*a*-4*d*, and to a yoke 7 suspended at the opposite side of the hoisting cylinder assembly 1 and above the opening 30. The wire 5 may, for example, be a steel or fiber rope. The wire 5 is operatively connected to a winch 6 mounted on the upper drill floor 2 so that the yoke 7 can be hoisted or lowered by the winch 6. The yoke 7 may also be hoisted or lowered by operating the hoisting cylinder assembly 1, i.e., extending or contracting the hoisting cylinders 13*a-f* so as to move the sheaves 4*a*-4*d* vertically.

The yoke 7 is arranged to carry or guide a tool 8 used for a drilling operation, a well intervention operation or a subsea installation operation. The tool is a drilling machine 8 in the shown embodiment.

A hoisting tower 15, for example a derrick structure, supports the hoisting cylinder arrangement 1. The hoisting tower 15 is mounted on the drill floor 3 or on the upper drill floor 2. The yoke 7 may comprise a dolly 31 which is arranged to move vertically along the hoisting tower 15 with the support of at least one rail 16. The hoisting tower 15 may have a mast top deck 32.

The winch 6 is mounted on the upper drill floor 2 near the lower part 1*b* of the hoisting cylinder assembly 1 so that the wire extends from the winch 6 to the sheaves 4*a*-4*d* substantially parallel to the hoisting cylinder assembly 1, i.e., substantially vertically. The winch 6 may alternatively be mounted on the drill floor 3, or below the drill floor 3, for example, inside the hull of the vessel. The winch 6 is thus aligned horizontally with the lower part 1*b* or positioned lower than the lower part 1*b*. Positioning the winch 6 at a low location in the vessel is beneficial for the stability of the vessel. Positioning the winch 6 below the drill floor 3 and/or inside the hull of the vessel also provides advantages that space is freed up on the drill floor 3 (where space is very limited), and that operations on or with the winch 6 can be carried out at a dedicated place which is more protected and where more space is available than on the drill floor 3. This may, for example, include spooling on new wire, or performing maintenance on the winch 6 or associated components. This may then be done without interfering with operations on the drill floor 3. An opening in the drill floor 3 for the wire(s) 5 can be arranged for this purpose.

The hoisting system may be arranged with a single wire between the winch 6 and the yoke 7. Multiple wires 5 are used in the shown embodiment. Each of the wires extend over the sheaves 4*a*-4*d* to the yoke 7. Six wires are used in the shown embodiment, with sheaves 4*d* and 4*a* having three grooves for accommodating three of the wires and sheaves 4*c* and 4*d* having three grooves for accommodating the other three wires. Each wire may alternatively have a dedicated sheave (or sheaves) in the top section 1*a* of the hoisting cylinder assembly 1. Providing a multi-line hoisting configuration improves safety and reduces the maintenance requirements (e.g., cut-and-slip of the wire) so that when using a winch together with a hoisting cylinder arrangement, the operational lifetime and uptime is not negatively affected.

The winch 6 has a base 42 and a winch drum 14. The winch drum 14 may be configured to accommodate a single layer of the wire 5. This reduces wear on the wire 5 so that the use of the winch 6 does not negatively affect the lifetime or operational uptime of the hoisting system.

Figure 4:
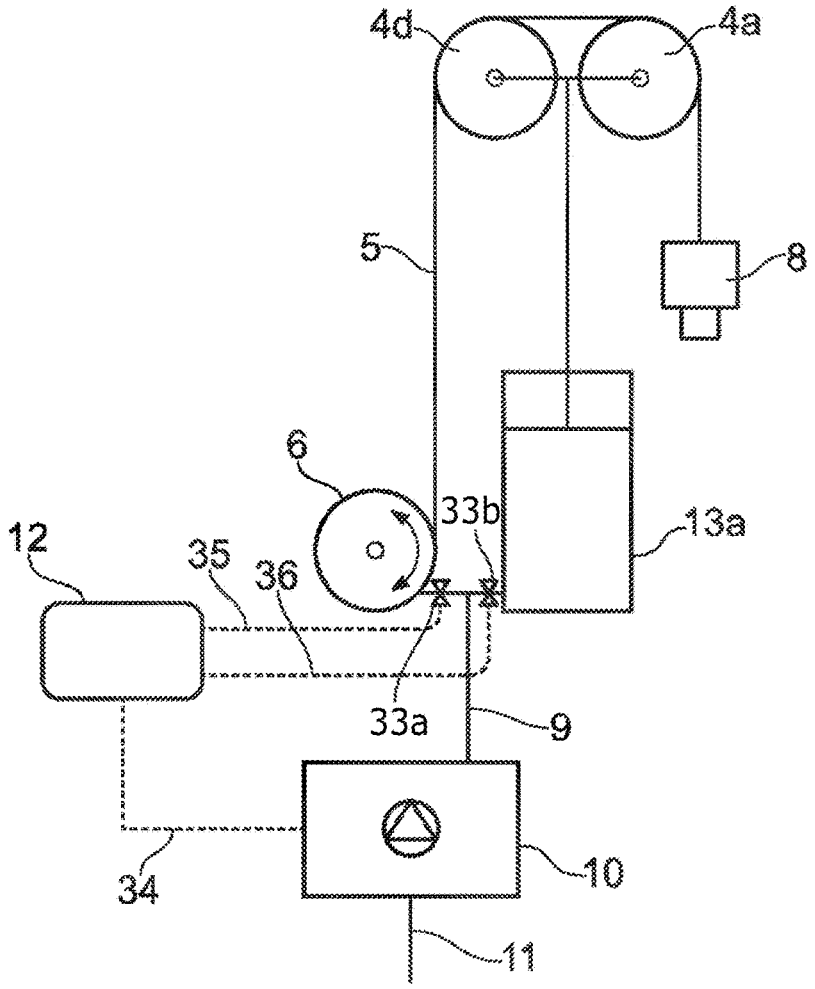
FIG. 4 shows a schematic view of a hoisting system.

Both the hoisting cylinder assembly 1 and the winch 6 may be hydraulically driven. FIG. 4 shows a schematic overview of the hoisting system's power distribution and control setup. A hydraulic power unit (HPU) 10 provides pressurised hydraulic fluid through hydraulic supply line 9. Both the winch 6 and the individual hydraulic hoisting cylinders 13*a-f* receives hydraulic power from the HPU 10. The hydraulic supply line 9 comprises appropriate valves 33*a* and 33*b* to control the hydraulic supply to the winch 6 and the hydraulic hoisting cylinders 13*a-f*, respectively. The HPU 10 is electrically powered via a power supply line 11 from the vessel. The winch 6 may alternatively be electrically powered via variable frequency drives. In such an embodiment, the system may include variable frequency control of both electrical motors for the winch 6, and for the motors on the HPU 10.

By providing a power distribution setup as shown in FIG. 4, the HPU 10 may be used to operate the winch 6 and/or the hydraulic hoisting cylinder arrangement 1. This reduces the required installed hydraulic power, e.g., the size of the HPU 10, while maintaining the system's capability of both high-speed and heavy lifting.

A controller 12 is provided to control the operation of the winch 6 and the hoisting cylinder assembly 1. The controller 12 may control the operation of the HPU 10 via a control line 34, the distribution of hydraulic energy through control of the valves 33*a* and 33*b* via control lines 35 and 36, and control of other operational aspects of the winch 6 and the hoisting cylinder assembly 1 via appropriate control lines (not shown in the drawings). This may include, for example, winch brakes to lock the position of the winch drum 14, mechanical locks to lock the position of the hoisting cylinders 13*a-f*, hydraulic lines connecting the winch 6 and/or the hoisting cylinders 13*a-f* to other components, such as accumulators, etc.

The controller 12 may be configured, in a first operational configuration, to maintain the winch 6 in a non-operating position while operating the hoisting cylinder assembly 1 and, in a second operational configuration, to maintain the hoisting cylinder assembly 1 in a non-operating position while operating the winch 6. This may be done by brakes, mechanical locks, hydraulic locks, or otherwise. For example, one can engage the brakes of the winch 6 when operating the hoisting cylinder assembly 1, or engage a mechanical lock on the hoisting cylinder assembly 1, or a hydraulic lock to close off the working chamber in the hoisting cylinders 13*a-f*, when operating the winch 6. The first operational configuration may include operating the hoisting cylinder assembly 1 for lifting purposes or for heave compensation purposes (see below). The second operational configuration may include operating the winch 6 for lifting purposes or for heave compensation purposes (see below).

In an embodiment of the present invention, the hoisting cylinder assembly 1 can, for example, be provided with higher lifting capacity than the winch 6. The winch 6 can, for example, have a lifting capacity of 200 tons, whereas the hoisting cylinder assembly 1 can, for example, have a lifting capacity of 750-1000 tons. This can be achieved by designing the wire 5, the winch drum 14, the winch brakes 40, 41 and other associated components with a capacity to withstand the loads generated by the operation of the hoisting cylinder assembly 1, while other components (e.g., the power supply) can be designed according to the winch's 6 lifting capacity. For example, the static braking capacity of the winch brakes 40, 41 may be designed to be higher than the maximum lifting capacity of the hoisting cylinder assembly 1. This allows the design of the winch 6 to be as small, light and compact as possible, while maintaining the overall lifting capacity and performance of the hoisting system 100. The ratio between the lifting capacity of the hoisting cylinder assembly 1 and the winch 6 may be more than two, more than three, more than four or more than five.

The winch 6 and/or the hoisting cylinder assembly 1 may be provided with heave compensation capability. The heave compensation capability may be passive, for example, using accumulators (not shown in the drawings) fluidly connected to the working chamber of the hoisting cylinders 13*a-f*, or active, i.e., actively controlling the operation of the winch 6 or the hoisting cylinder assembly 1 according to measured vessel motion. Heave compensation may be controlled by the controller 12, by a separate controller, or manually.

Improved heave compensation performance can be achieved by providing both the winch 6 and the hoisting cylinder assembly 1 with heave compensation capability. For example, when requiring heave compensation under heavy loads, the hoisting cylinder assembly 1 can be used, while, for example, the winch 6 can be designed to provide fast response and/or low weight variations when compensating on light loads.

The hoisting cylinders 13*a-f* can, for example, be designed with a stroke length s (see FIG. 3) which is sufficiently large to be able to move the yoke 7 along substantially the full lifting height h of the hoisting system. The stroke length s may be (i) more than one fifth (20%) of, (ii) more than one fourth (25%) of, (iii) more than one third (33%) of, (iv) more than 45% of, or (v) substantially equal to half the full lifting height h of the hoisting system. This provides that both the hydraulic cylinder assembly 1 and the winch 6 can operate the hoisting system over a significant part, or the full, operational lifting height of the system, and that both the hydraulic cylinder assembly 1 and the winch 6 can carry out lifting operations requiring such a lifting height.

Figure 5:
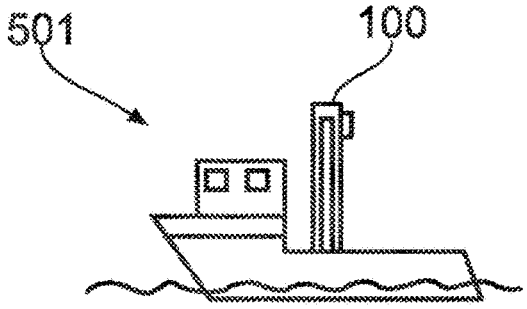
FIG. 5 shows a drillship having a hoisting system.
Figure 6:
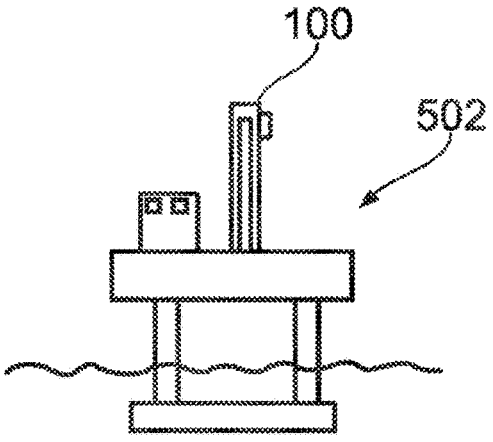
FIG. 6 shows a drilling rig having a hoisting system.

FIG. 5 shows a schematic illustration of a hoisting system 100 arranged on a drillship 501. FIG. 6 shows a schematic illustration of a hoisting system 100 arranged on a drilling rig 502. The floating structure on which the hoisting system is arranged may be of any type, such as a barge, a semi-submersible, a cylindrical floater, or a single-hull or multi-hull ship shaped vessel.

Figure 7:
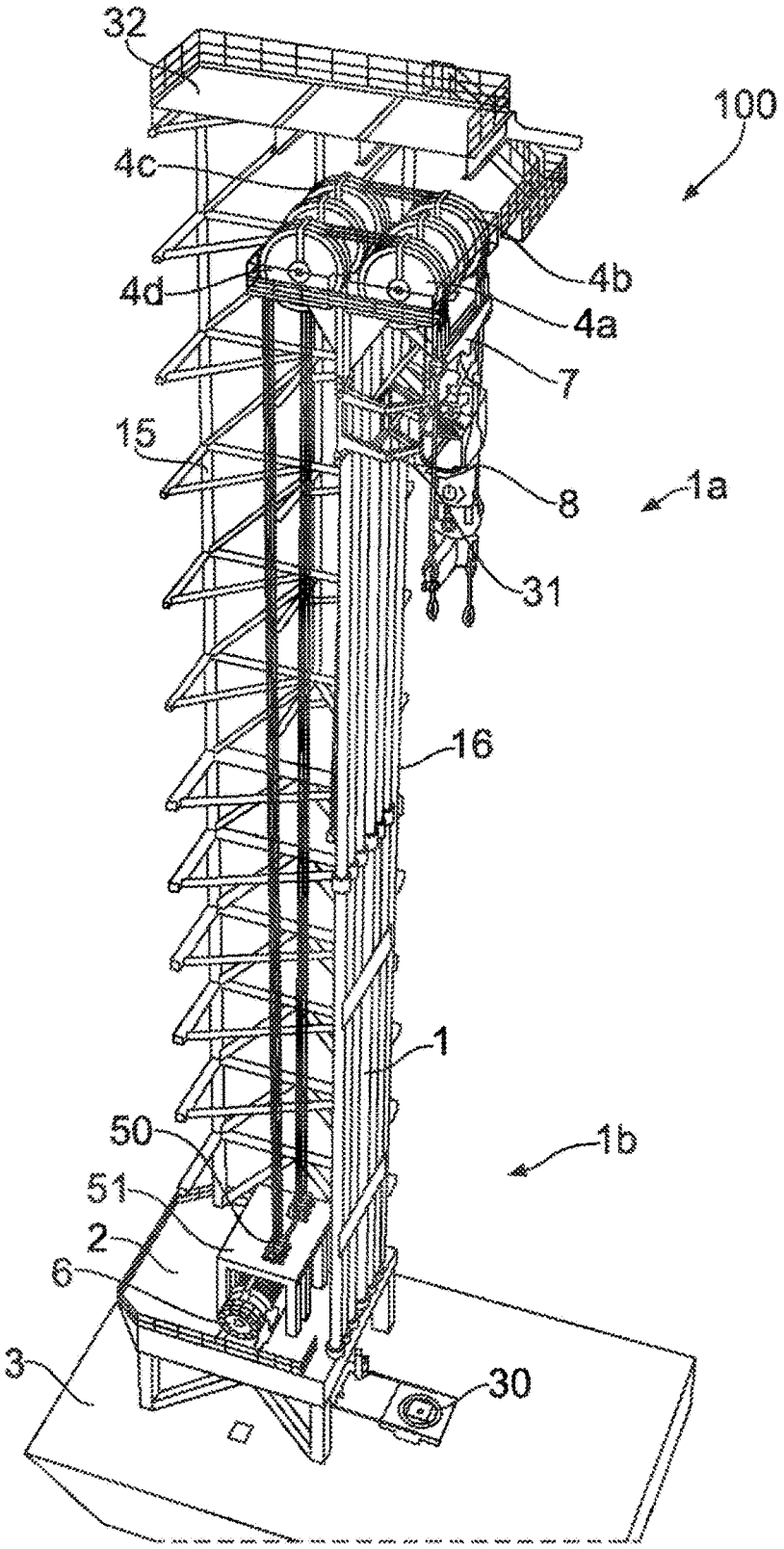
FIG. 7 shows a hoisting system.
Figure 8:
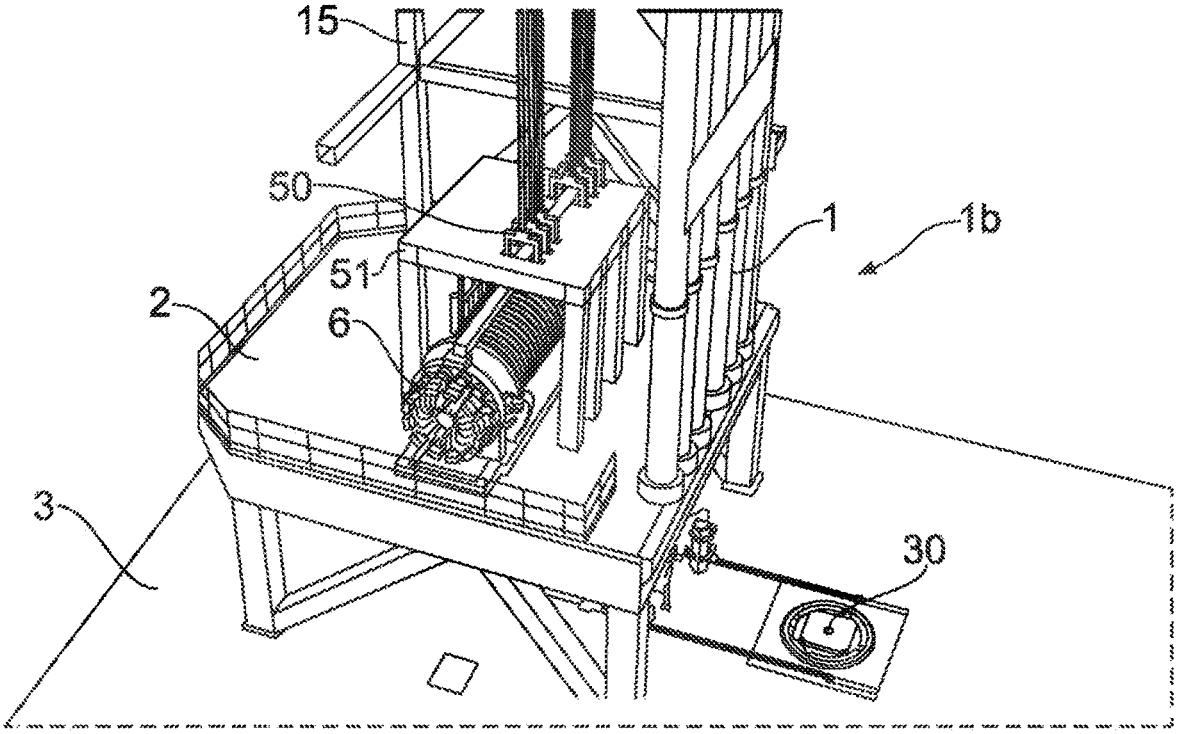
FIG. 8 shows details of the hoisting system of FIG. 7.
Figure 9:
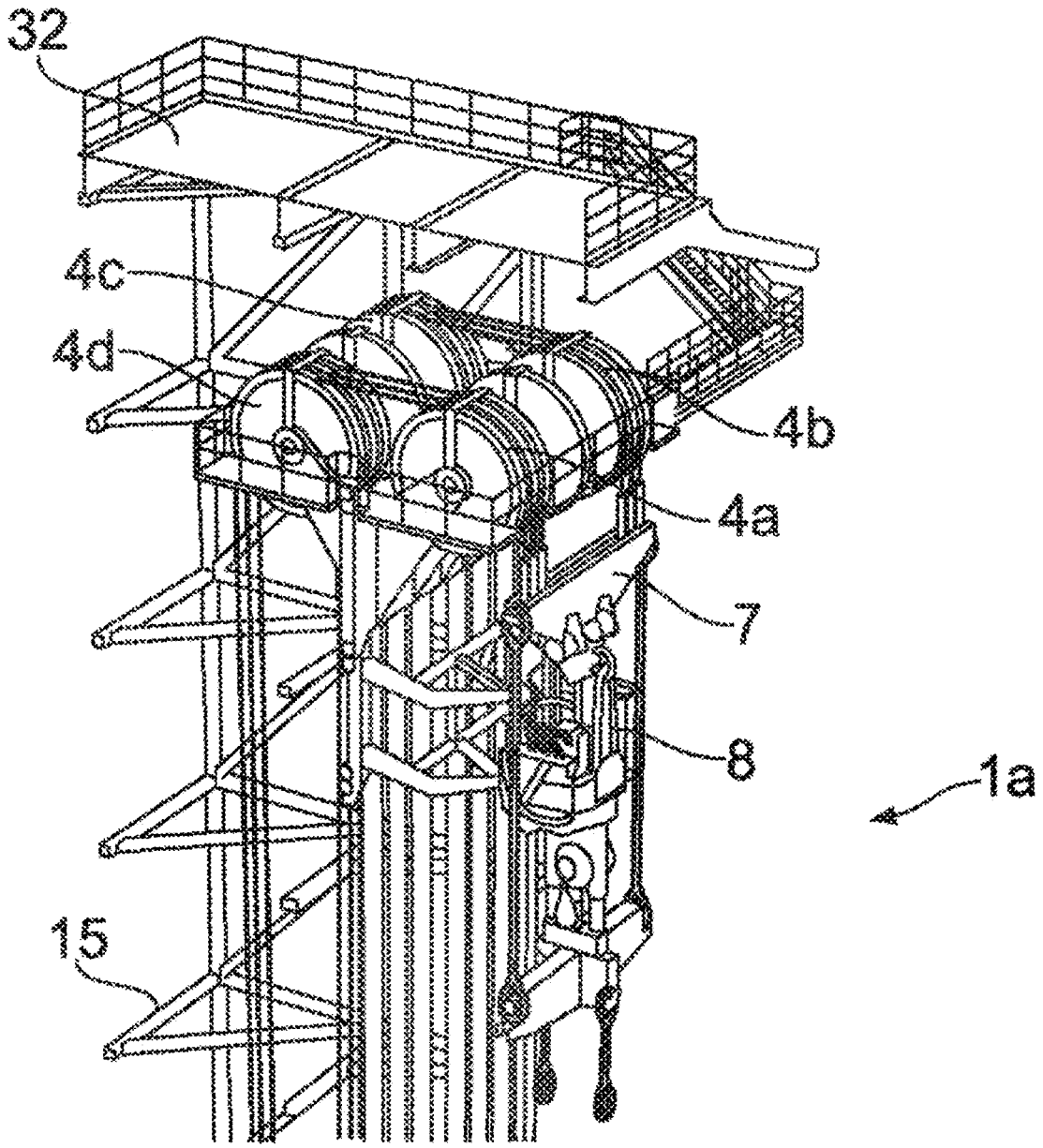
FIG. 9 shows details of the hoisting system of FIG. 7.

In an embodiment, illustrated in FIGS. 7-9, the hoisting system 100 further comprises an anchor 50 fixed in relation to the lower part 1*b* and configured to hold the wire(s) 5 fixed. The anchor 50 can be aligned horizontally with the lower part 1*b* or positioned lower than the lower part 1*b*. By providing an anchor 50 to which the wire(s) 5 can be fixed, it is possible to remove the wire(s) 5 from the winch 6 and fix these in the vessel structure, for example, when carrying out heavy lifts and/or to free the winch 6 for maintenance, repairs, or preparation for subsequent operations. Providing a hoisting system 100 with a first operational configuration in which the wire(s) 5 is configured to connect to the winch 6 and a second operational configuration in which the wire(s) 5 is configured to connect to the anchor 50 thus improves the design flexibility and/or operational flexibility of the system. For example, by providing anchors 50, the requirements on the brakes 40, 41 and other components of the winch 6 can be reduced, which can allow these to be designed for lower maximum capacity if that is desirable.

FIG. 8 shows an embodiment where the anchor 50 is arranged vertically spaced above the winch 6. This allows the wire(s) 5 to be fixed along the path parallel to the hoisting cylinder assembly 1 so that no angle which would create a moment force acting on the hoisting cylinder assembly 1 is created.

In this embodiment, the anchor 50 is arranged on a support element 51 which spans at least part of the winch 6. The support element 51 may comprise an opening 53 (see FIG. 11) which is arranged for the wire(s) 5 to extend through. This eases the change in operational configuration between a setup with the wire(s) 5 fixed to the anchor 50, and the wire(s) 5 operatively connected to the winch 6. The anchor 50 may alternatively be arranged on the drill floor 3, or below the drill floor 3. In an embodiment of the present invention, the winch 6 is arranged below the drill floor 3 and the anchor 50 is arranged on the drill floor 3. This allows the wire(s) 5 to be anchored on the drill floor 3 while the winch 6 can be accessed in its location below the drill floor 3, for example, for maintenance or preparation for subsequent operations. Such activities can then be carried out without interfering with drill floor 3 activities, and maintaining the operational capability of the hoisting system via the hoisting cylinder assembly 1.

Figure 10:
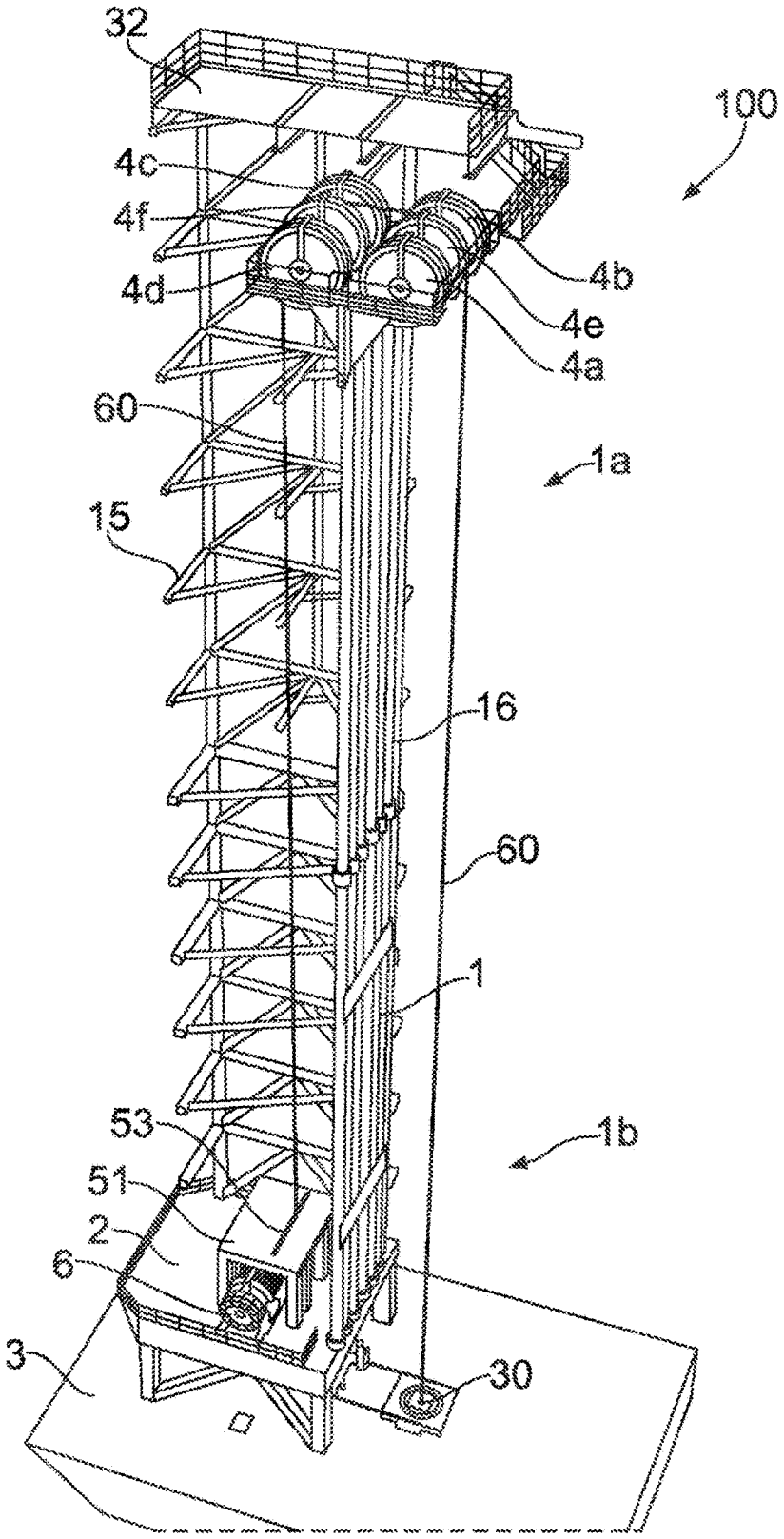
FIG. 10 shows a hoisting system.
Figure 11:
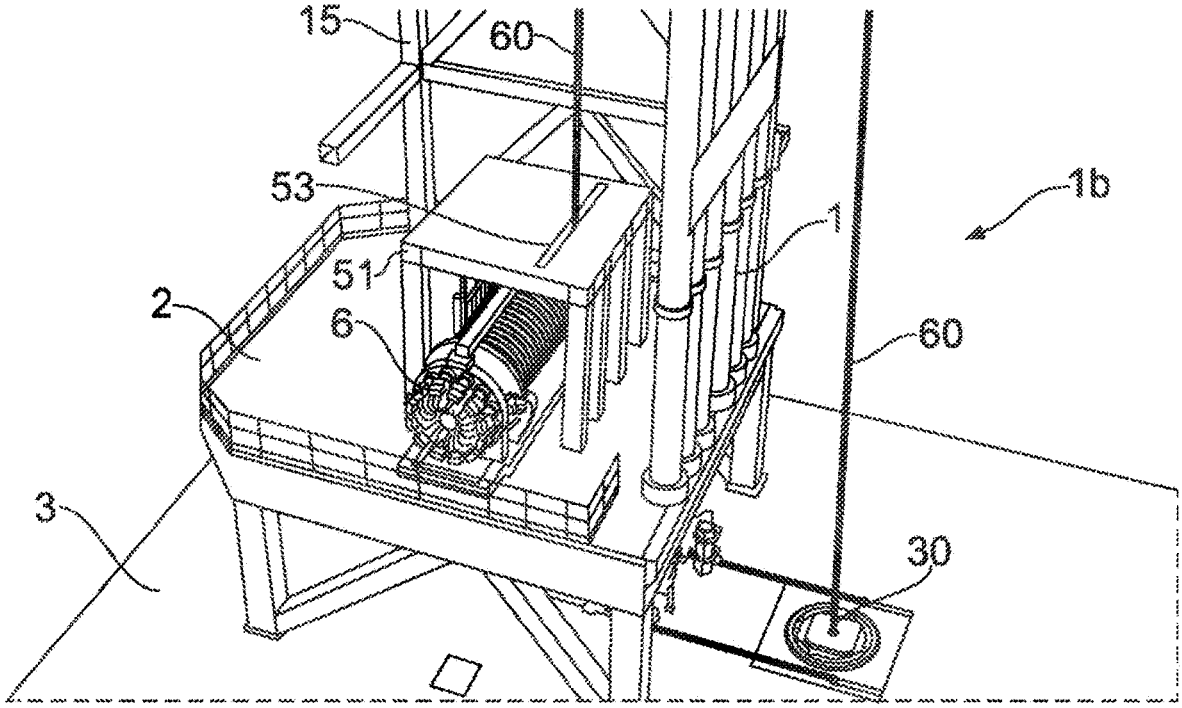
FIG. 11 shows details of the hoisting system of FIG. 10.
Figure 12:
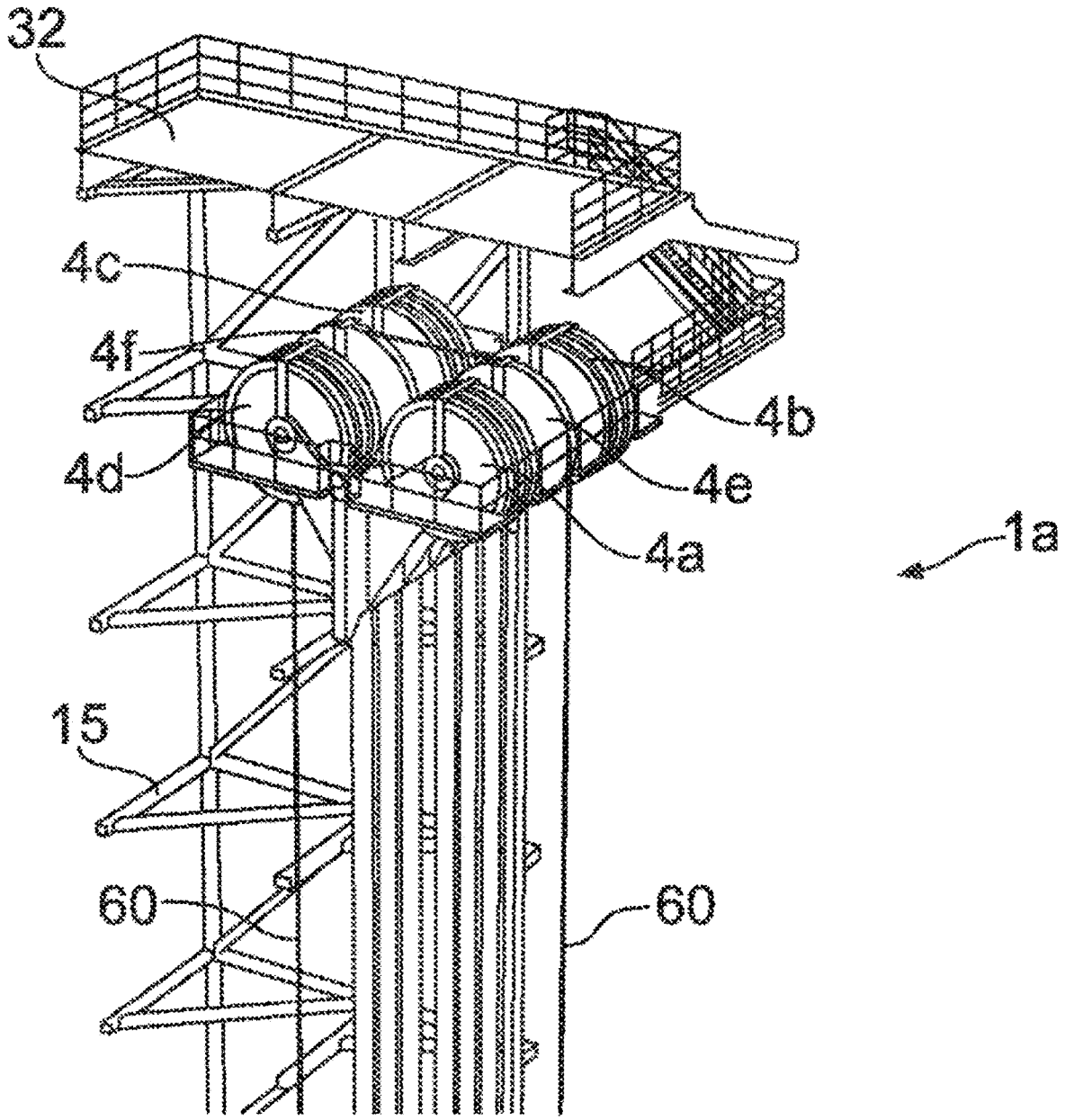
FIG. 12 shows details of the hoisting system of FIG. 10.

FIGS. 10-12 show an embodiment where the hoisting system 100 has a winch 6 with a wire 60 configured to extend from the winch 6 via at least one sheave 4*e-f* in the upper part 1*a* of the hoisting cylinder assembly 1, and through the opening 30 in a drill floor 3. The wire 60 can be a single wire which has a length that permits subsea lifting operations, for example, landing equipment on the sea floor.

The hoisting system 100 may, additionally, have a wire anchor 50 and one or more wires 5 which suspend a yoke 7 and a tool 8, as shown in FIG. 7. (These components are omitted in FIGS. 10-12 only for clarity.) The hoisting system 100 can alternatively be reconfigured between the operational modes so that the wires 5, yoke 7 and tool 8 are removed before operating the winch 6 with the longer wire 60, and the wire 60 can be removed before operating the hoisting system 100 in cylinder lifting mode.

The wires 5 and associated components may otherwise be configured similarly as described above.

An arrangement according to this embodiment permits long wireline operations, e.g., to the sea floor, to be carried out by the hoisting system 100, while, for example, heavy lifting operations can be carried out by the cylinder hoisting assembly 1. This may include, for example, landing heavy equipment via a drill pipe string, installing tubulars, such as casing, or carrying out drilling operations.

If using the wire 60 with the yoke 7 and tool 8 in place, the dolly 31 can be arranged to be retractable so as to not interfere with the wire 60. In such a design, the dolly 31 can have a first operational position in which the tool 8 is aligned vertically above the opening 30 and a second operational position in which the tool 8 is retracted to a position in which the tool 8 is horizontally spaced from the opening 30.

Both the wire 60 and the wire(s) 5 advantageously extend upwardly to the respective sheave 4*a-f* along a path which is substantially parallel to a longitudinal axis of the at least one hoisting cylinder 13*a-f*. This minimises side forces and the moment acting on the hoisting cylinder assembly 1.

The winch 6 and hoisting cylinder assembly 1 may be hydraulically driven and configured in the same way as described above.

The winch 6 and/or the hoisting cylinder assembly 1 can be provided with heave compensation capability. A controller 12 may be arranged to control the operation, similarly as described above. By individually controlling the winch 6 and the hoisting cylinder assembly 1, it is possible to optimise operation of the hoisting system 100 for any type of operation. Energy usage can also be better controlled and optimised. For example, for light loads and/or high-speed hoisting, the hoisting cylinder assembly 1 can be put in a non-operating state while the winch 6 carries out all the hoisting work. The winch 6 can conversely be put in a non-operating state, for example, by applying winch brakes, and the hoisting cylinder assembly 1 may carry out the hoisting.

It is advantageously possible to use one unit for hoisting and one for heave compensation. For example, if using the winch 6 for subsea landing operations, the hoisting cylinder assembly 1 can be operated to provide heave compensation.

By providing a hoisting system according to embodiments described herein, substantial operational flexibility can be achieved to allow a hoisting system to be operated according to specific needs for various types of operation. By providing a winch 6 and a hoisting cylinder assembly 1, the hoisting system 100 can provide enhanced performance in different operating modes, and the components of the hoisting system can be designed in an optimised way, for example, for losses (e.g., friction), longer lifetime and lower maintenance requirements. For example, by designing the winch 6 to carry out high-speed, low-load lifts (for example, during tripping operations), the hydraulic cylinder assembly 1 and its individual components (e.g., seals, bearings, and hydraulic system) do not need to be designed and dimensioned for high-speed operation, but can be optimised for lifts at a relatively lower speed. This reduces the size, cost and complexity of the hydraulic system. The demands on the power supply are similarly relaxed, and a lower installed power can be used.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The present invention is not limited to embodiments described herein; reference should be had to the appended claims.

What is claimed is:

1. A hoisting system comprising:

a hoisting cylinder assembly which is arranged vertically, the hoisting cylinder assembly comprising at least one hoisting cylinder, a lower part, and an upper part, the upper part being moveable in relation to the lower part;

at least one sheave arranged in the upper part of the hoisting cylinder assembly;

a winch comprising a base which is fixed in relation to the lower part; and a first wire which is operatively connected to the winch and which extends from the winch via the at least one sheave to a yoke so as to suspend the yoke from the at least one sheave, wherein, a lifting capacity of the hoisting cylinder assembly is higher than a lifting capacity of the winch.

2. The hoisting system as recited in claim 1, wherein, the winch is hydraulically driven, and the hoisting cylinder assembly is hydraulically driven.

3. The hoisting system as recited in claim 1, further comprising:

a hydraulic supply line which is configured to supply hydraulic fluid to the hoisting cylinder assembly and to the winch.

4. The hoisting system as recited in claim 1, further comprising at least one second wire extending from the winch via the at least one sheave to the yoke.

5. The hoisting system as recited in claim 4, wherein the winch comprises a winch drum which is configured to accommodate one of the first wire or one of the at least one second wire thereon.

6. The hoisting system as recited in claim 1, wherein, the winch comprises at least one brake, and the at least one brake comprises a static braking capacity which is higher than the lifting capacity of the hoisting cylinder assembly.

7. The hoisting system as recited in claim 1, further comprising:

a controller which is configured to, control an operation of the winch, control an operation of the hoisting cylinder assembly, in a first operational configuration, maintain the winch in a non-operating position while operating the hoisting cylinder assembly, and in a second operational configuration, maintain the hoisting cylinder assembly in a non-operating position while operating the winch.

8. The hoisting system as recited in claim 1, wherein the hoisting cylinder assembly is arranged on a drill floor, the winch is positioned vertically lower than the lower part, and the winch is positioned below the drill floor.

9. A hoisting system comprising:

a hoisting cylinder assembly which is arranged vertically, the hoisting cylinder assembly comprising at least one hoisting cylinder, a lower part, and an upper part, the upper part being moveable in relation to the lower part;

at least one sheave arranged in the upper part of the hoisting cylinder assembly;

a winch comprising a base which is fixed in relation to the lower part;

a wire anchor which is fixed in relation to the lower part;

a wire extending via the at least one sheave to a yoke so as to suspend the yoke from the at least one sheave; and a support element comprising an opening which spans at least part of the winch, the support element being configured so that the wire extends therethrough and to span at least part of the winch, wherein, the wire is configured to connect to at least one of the winch and the wire anchor, the wire anchor is configured to hold the wire so as to be fixed, the wire anchor is arranged so as to be spaced vertically above the winch, and the wire anchor is arranged on the support element.

10. A hoisting system comprising:

a hoisting cylinder assembly which is arranged vertically, the hoisting cylinder assembly comprising at least one hoisting cylinder, a lower part, and an upper part, the upper part being moveable in relation to the lower part;

at least one sheave arranged in the upper part of the hoisting cylinder assembly;

a winch comprising a base which is fixed in relation to the lower part; and a wire configured to extend from the winch via the at least one sheave and through an opening in a drill floor;

a wire anchor which is fixed in relation to the lower part;

a support element comprising an opening which spans at least part of the winch, the support element being configured so that the wire extends therethrough and to span at least part of the winch, wherein, the wire anchor is arranged so as to be spaced vertically above the winch, and the wire anchor is arranged on the support element.

11. The hoisting system as recited in claim 10, wherein the wire is a first wire and the hoisting system further comprises:

a second wire configured to extend from the wire anchor via the at least one sheave to a yoke so as to suspend the yoke from the at least one sheave.

12. The hoisting system as recited in claim 10, wherein, the yoke is configured to carry or guide a tool, the yoke comprises a dolly, and the dolly comprises a first operational position in which the tool is aligned vertically above the opening in the drill floor and a second operational position in which the tool is retracted to a position in which the tool is horizontally spaced from the opening in the drill floor.

* * * * *